US010121410B2

(12) United States Patent
Zheng et al.

(10) Patent No.: US 10,121,410 B2
(45) Date of Patent: Nov. 6, 2018

(54) POWER EFFICIENT ADAPTIVE PANEL PIXEL CHARGE SCHEME

(71) Applicant: Apple Inc., Cupertino, CA (US)

(72) Inventors: Fenghua Zheng, San Jose, CA (US); Sandro H. Pintz, Menlo Park, CA (US)

(73) Assignee: Apple Inc., Cupertino, CA (US)

( * ) Notice: Subject to any disclaimer, the term of this patent is extended or adjusted under 35 U.S.C. 154(b) by 667 days.

(21) Appl. No.: 14/487,020

(22) Filed: Sep. 15, 2014

(65) Prior Publication Data

US 2015/0364088 A1 Dec. 17, 2015

Related U.S. Application Data

(60) Provisional application No. 62/012,185, filed on Jun. 13, 2014, provisional application No. 62/017,098, filed on Jun. 25, 2014.

(51) Int. Cl.

| | |
|---|---|
| ***G09G 3/32*** | (2016.01) |
| ***G09G 3/3216*** | (2016.01) |
| ***G09G 3/20*** | (2006.01) |

(52) U.S. Cl.

CPC ..... *G09G 3/3216* (2013.01); *G09G 3/2007* (2013.01); *G09G 2310/027* (2013.01); *G09G 2310/0221* (2013.01); *G09G 2310/0291* (2013.01); *G09G 2330/021* (2013.01); *G09G 2340/16* (2013.01)

(58) Field of Classification Search

CPC ..... G09G 3/2007; G09G 2340/16; G09G 2330/021

See application file for complete search history.

(56) References Cited

U.S. PATENT DOCUMENTS

| | | | | |
|---|---|---|---|---|
| 5,739,804 A * | 4/1998 | Okumura | G09G 3/2007 | 345/100 |
| 7,580,047 B2 * | 8/2009 | Ng | G09G 3/2092 | 345/205 |
| 2006/0290638 A1 * | 12/2006 | Kang | G09G 3/2011 | 345/98 |
| 2013/0307838 A1 * | 11/2013 | Kim | G09G 5/001 | 345/212 |
| 2015/0228241 A1 * | 8/2015 | Lee | G09G 3/3688 | 345/212 |

* cited by examiner

*Primary Examiner* — Abbas Abdulselam

(74) *Attorney, Agent, or Firm* — Morgan, Lewis & Bockius LLP

(57) ABSTRACT

This application relates to systems, methods, and apparatus for reducing the power consumption of a display panel. Specifically, the embodiments discussed herein relate to a panel pixel charge scheme that allows the current output of a display driver to be modified based on the content to be displayed at the display panel. The display driver can compare current and upcoming display content in order to determine how the line voltage for one or more output lines will change over time. If, based on the comparison, the voltage for an output line is not going to vary substantially over time, the bias current output from the display driver can be modified in order to save power. The modification to the bias current can depend on the amount of change the line voltage will undergo in subsequent executions of the content data.

20 Claims, 7 Drawing Sheets

POWER EFFICIENT ADAPTIVE PANEL PIXEL CHARGE SCHEME

CROSS-REFERENCE TO RELATED APPLICATIONS

The present application claims the benefit of U.S. Provisional Application No. 62/012,185, entitled "POWER EFFICIENT ADAPTIVE PANEL PIXEL CHARGE SCHEME" filed Jun. 13, 2014 and U.S. Provisional Application No. 62/017,098, entitled "POWER EFFICIENT ADAPTIVE PANEL PIXEL CHARGE SCHEME" filed Jun. 25, 2014, the contents of which are incorporated herein by reference in their entirety for all purposes.

FIELD

The described embodiments relate generally to saving power in a display panel. Specifically, the embodiments set forth herein relate to systems, methods, and apparatus for optimizing a current setting of a display driver in a display panel based on display content.

BACKGROUND

Display monitors have become increasingly more advanced as a result of new devices and materials being incorporated into display monitors. Although many new materials can allow a display monitor to provide exquisite images, certain materials can require large amounts of energy. Additionally, such materials can require a large buffer of current that is constantly being depleted and recharged in order to accurately display image data at the display monitor. Specifically, in display monitors having light emitting diode (LED) matrices, there is a high demand of current and voltage when the display monitor is constantly transitioning the LED's between different levels of operation. This issue is exacerbated in higher resolution displays where LED matrices are denser and the combined energy demand for the rows and columns of the LED matrices is substantial.

SUMMARY

This paper describes various embodiments that relate to systems, methods, and apparatus for reducing the power consumption of a display device. The embodiments discussed herein include a method for providing a data line output from a display driver of a display device. The method can include a step of providing a modified bias current of the display driver according to a line charge differential. The line charge differential can be generated based on a comparison between at least one bit of a current display variable and a subsequent display variable.

In other embodiments, a system for reducing power consumption of a display device based on content data to be displayed at the display device is set forth. The system can include a display driver electrically coupled to a data input unit. The display driver can be configured to modify a bias current output of the display driver when content data provided by the data input unit is indicative of a charge differential that is within one or more charge differential thresholds accessible to the display driver.

In yet other embodiments, a display driver configured to reduce power consumption based on content data is set forth. The display driver can include a current output unit, and a data control unit. The data control unit can be configured to determine a modified bias current for the current output unit based on a voltage differential generated by sequentially comparing a first content variable to a second content variable. The second content variable can be arranged to be executed subsequent to the first content variable.

Other aspects and advantages of the invention will become apparent from the following detailed description taken in conjunction with the accompanying drawings which illustrate, by way of example, the principles of the described embodiments.

BRIEF DESCRIPTION OF THE DRAWINGS

The disclosure will be readily understood by the following detailed description in conjunction with the accompanying drawings, wherein like reference numerals designate like structural elements.

DETAILED DESCRIPTION

Figure 1A:
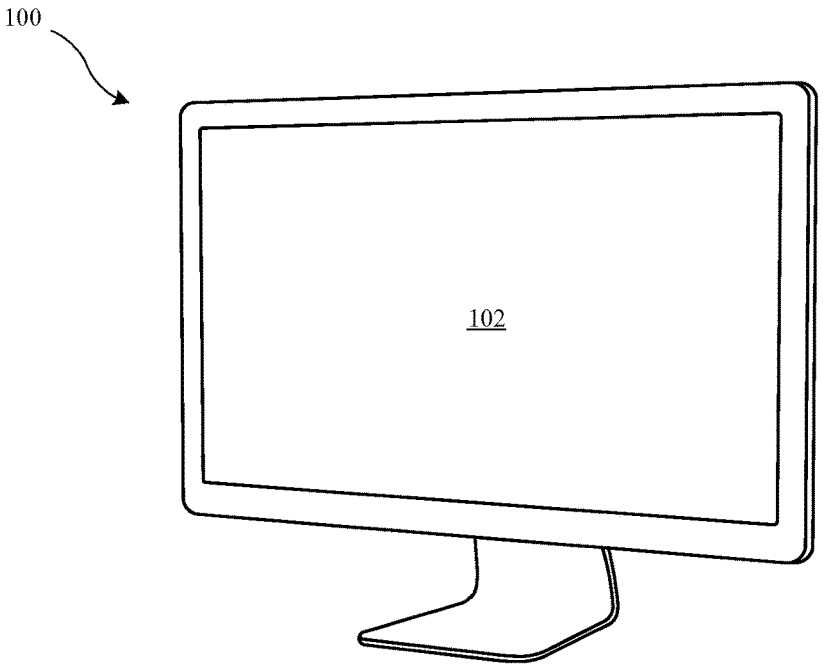
FIGS. 1A and 1B illustrate perspective views of a display panel and a light emitting diode (LED) matrix diagram.

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

The embodiments discussed herein relate to apparatus, systems, and methods for reducing the energy consumption in a display panel. Specifically, the embodiments relate to a power efficient adaptive panel pixel charge scheme. The charge scheme allows one or more display drivers or timing controllers of a display panel to charge a data line in a light emitting diode (LED) matrix according to a current content data and future content data, as further discussed herein. An LED will receive current when both the data line, corresponding to the column of the LED matrix, and the row line, corresponding to the row of the LED matrix, receives adequate charge. A row is charged by a row driver and a data line is charged by a display driver or column driver. The data line is frequently recharged by the display driver in order to illuminate LED's in multiple rows. However, a data line can retain some charge after illuminating an LED in a row line and subsequently use some of the remaining charge to illuminate an LED in an adjacent or subsequent row line. As discussed herein, the display driver can be configured to reduce a bias current to the data line when illuminating LED's in subsequent or neighboring rows depending on the content data provided to the display driver.

The content data can refer to bits of an array that determine the various levels of an analog signal that will drive the data line. For example, the display driver can have a 6, 8, or 10 bit resolution, and the square of the resolution will determine the number of levels of analog signals (i.e., $2^8=256$). Depending on the content data, a voltage will be established at the data line according to one of the levels of analog signal defined by the data content. Therefore, the voltage at the data line will change depending on how the content data changes from row line to row line. The relationship between the voltage and the bias current needed to charge the data line can be defined by the following formula:

$$I \cdot \Delta t = C \cdot \Delta V \quad (1)$$

In this formula, the settling time (Δt) refers to a change in settling time that the data line can take to reach a voltage or charge level corresponding to the content data. The capacitance (C) refers to the capacitance of the data line. The bias current (I) refers to a bias current at the data line that can achieve a voltage change (ΔV). The voltage change (ΔV) refers to a difference between an initial and final voltage at the data line. During operation of the display driver, the content data can cause the display driver to change the output voltage by less than half of the maximum output voltage (the output voltage corresponds to the analog signal level). In this case, and according to the formula above, a settling time (Δt) would be less than half for the same bias current (I) because the voltage change (ΔV) is less than half. Furthermore, in order to achieve the same settling time (Δt) when the voltage of the data line remains constant, less than half of the bias current (I) will be needed because the voltage change (ΔV) is even less when the voltage of the data line remains constant. Therefore, by reducing the bias current based on content data to be executed at the display panel, a substantial amount of power can be saved.

An algorithm for reducing the bias current according to the content data can be performed in a variety of ways according to the embodiments described herein. In some embodiments, a data control unit coupled to a display driver or column driver, or the display driver itself, can generate a control signal for modifying the bias current according to current content data and subsequent content data. The data control unit can determine the difference between a current analog signal level corresponding to the current data content and a subsequent analog signal level corresponding to subsequent content data. The difference can be based on one or more bits (e.g., a most significant bit for content data) provided to the data control unit. For example, if the subsequent content data is to have an analog signal level that is a percentage value less than the analog signal level of the current content data, the data control unit will use the percentage value to reduce the bias current for the subsequent content data. After current content data is executed and the first row line (N) is energized, the bias current is adjusted according to a modified bias current value. The modified bias current value can be a fraction or percentage of the bias current used for the current content data, or a fraction or percentage of a normal bias current used when executing the subsequent content data. Thereafter, the data line is charged with the modified bias current when the subsequent content data is executed. This algorithm can be applied to all rows of an LED matrix in a display panel. Upon the final row being charged and a blank period occurring before a subsequent frame is provided to the LED matrix, the bias current can be restored to a normal value for illuminating the LED's of the LED matrix. For example, the normal value can correspond to the maximum analog signal level or a media analog signal level for preparing the display driver for a worst case charging scenario.

These and other embodiments are discussed below with reference to FIGS. 1-7; however, those skilled in the art will readily appreciate that the detailed description given herein with respect to these figures is for explanatory purposes only and should not be construed as limiting.

Figure 1B:
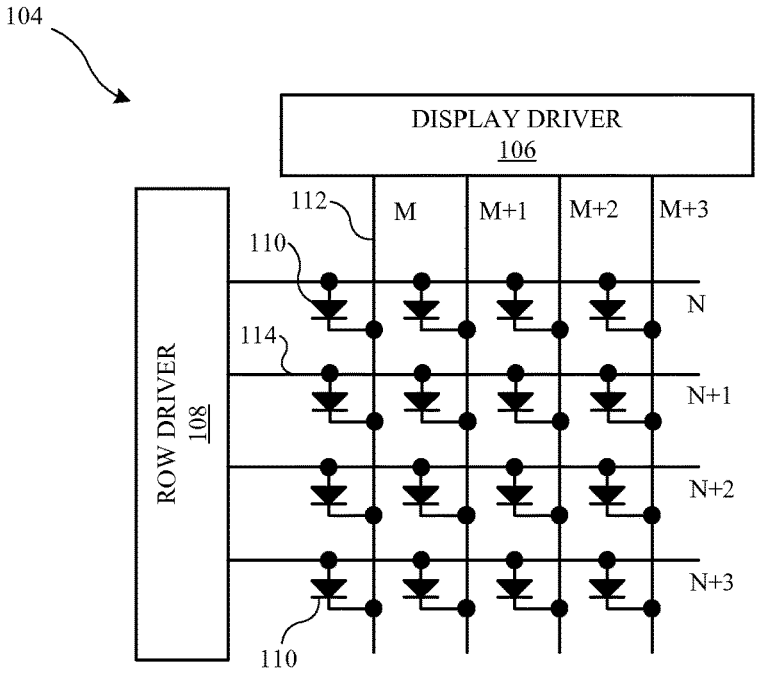

FIGS. 1A and 1B illustrate perspective views 100 of a display panel 102 and an LED matrix diagram 104. The display panel 102 can be a desktop computer using an LED matrix to output light at the display panel 102. Additionally, display panel as used herein can refer to the display of a laptop computing device, desktop computing device, media player, cellular phone, or any other electronic device incorporating a display having LED's. FIG. 1B illustrates an LED matrix diagram 104 for use in the display panel 102, or any other suitable display device. In order to cause an LED 110 to illuminate, each data line 112 and row line 114 is individually provided electrical current. For example, in order to illuminate the LED 110 at row N+1 and column M+1, both row N+1 and column M+1 must concurrently receive electrical current. If the next LED 110 to be illuminated is the LED 110 corresponding to row N+2 and column M+1, the display driver 106 may continue providing a bias current to column M+1 until the row driver 108 stops the current at row N+1 and provides current to N+2. By keeping the bias current at column M+1, the display driver 106 is prepared to assist in illuminating other LED's. However, this can result in wasted power when the LED 110 in the next row and same data line requires the same amount of charge or a percentage of the charge as required by an LED 110 in the previous row and same data line. For example, when the column requires the same amount of voltage for a subsequent row, the bias current required for the column will be less for the subsequent row because the data line will already have some charge or voltage remaining. This is the result of the capacitance of the data line being small compared to the capacitance of a pixel to be illuminated by the LED 110. Therefore, the display driver 106, or a data control unit communicatively coupled to the display driver 106, can determine how much to reduce the bias current in order to save power and still provide adequate charge to the data line for different content data.

Figure 2:
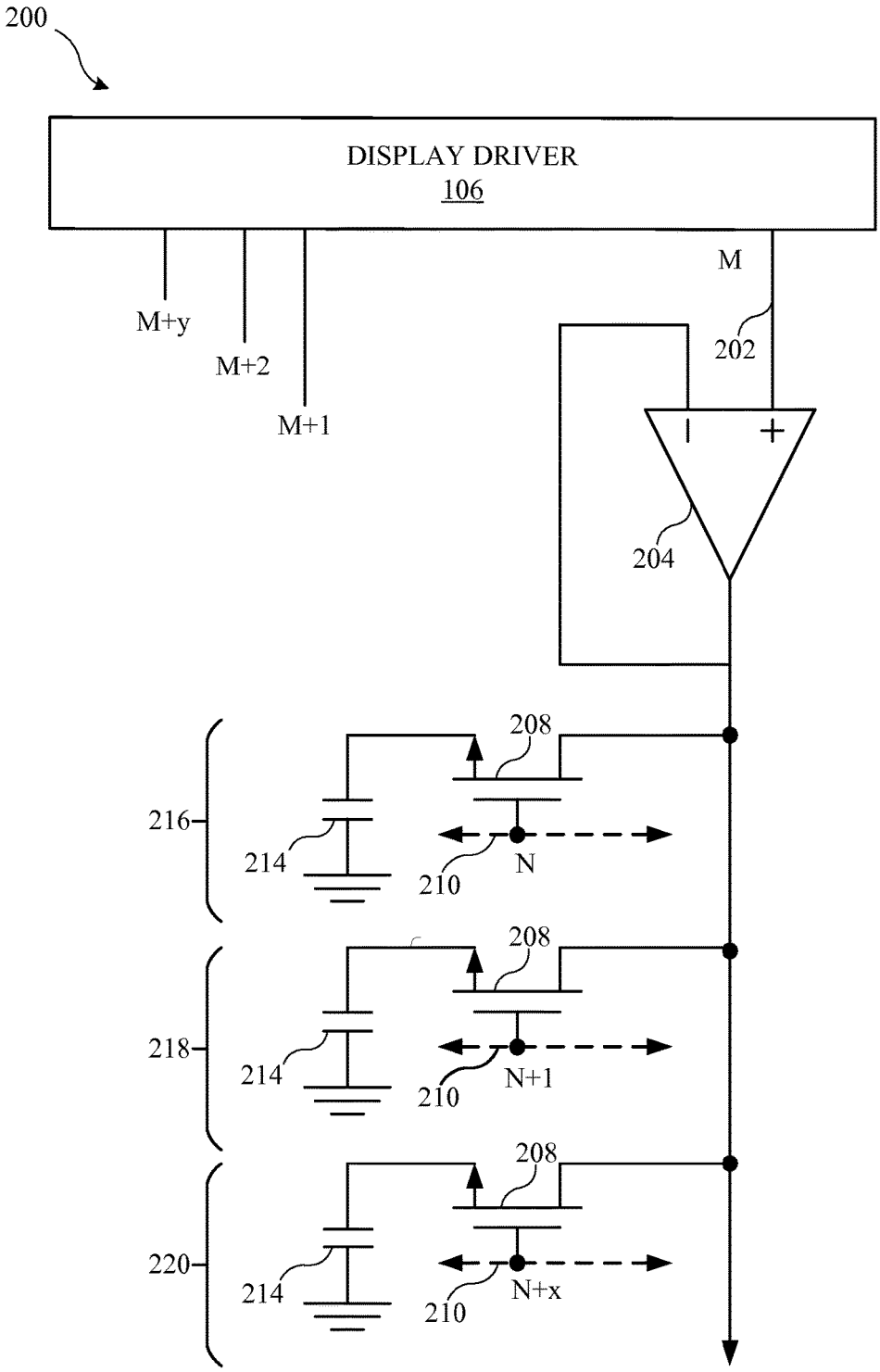
FIG. 2 illustrates a diagram of a display driver configured to adaptively reduce the power consumption of a display panel according to some embodiments discussed herein.

FIG. 2 illustrates a diagram 200 of a display driver 106 configured to adaptively reduce the power consumption of a display panel 102 according to some embodiments discussed herein. The display driver 106 can be electrically coupled to one or more data lines 202 (e.g., M, M+1, M+1, M+2, M+y, and so on for y>1). The output of the display driver 106 is a bias current, which can be buffered in the data line buffer 204 prior to reaching each of the transistors 208. Each of the transistors 208 are connected to the data line 202 at a portion of the data line corresponding to a row of an LED matrix, in which the display driver 106 can be electrically coupled to. For example, a transistor 208 is coupled at the first row 216, second row 218, and third row 220, in order to allow or prevent charge from being received at each storage capacitor 214. The storage capacitors 214 store a pixel voltage, which is used to control the LED current at each row and column. Each transistor 208 can be electrically coupled to a row driver or other device suitable for providing current to the LED's in each row line 210 (e.g., N, N+1, N+x, and so on for x>1) according to the data content to be displayed at the display panel 102.

In some embodiments, the display driver 106 can operate to adjust a voltage and/or current of an individual data line 202. In other embodiments, the display driver 106 can be divided into several sections (e.g., 4 sections). In this way, each section has its own bias current setting in order to accomplish the power saving scheme discussed herein without having to manage a larger number of data lines 202. For example, a 960-channel display driver 106 can be divided into four 240-channel sections, so that each 240-channel section can have its own bias current generation circuit. Thereafter, the maximum level of each 240-channel section can be used to set the bias current for that 240-channel section.

Figure 3A:
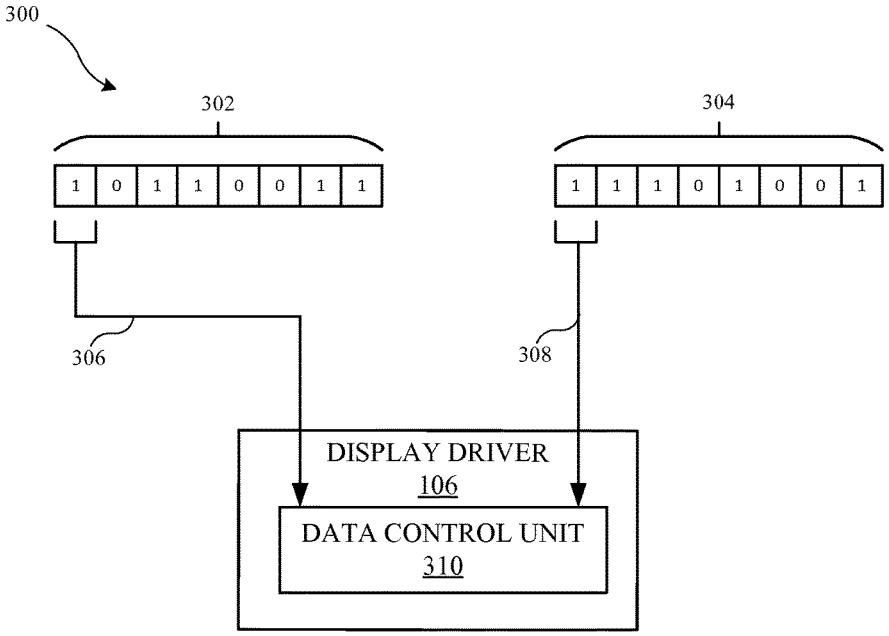
FIGS. 3A and 3B illustrate block diagrams and for executing the adaptive power saving scheme according to some embodiments discussed herein.
Figure 3B:
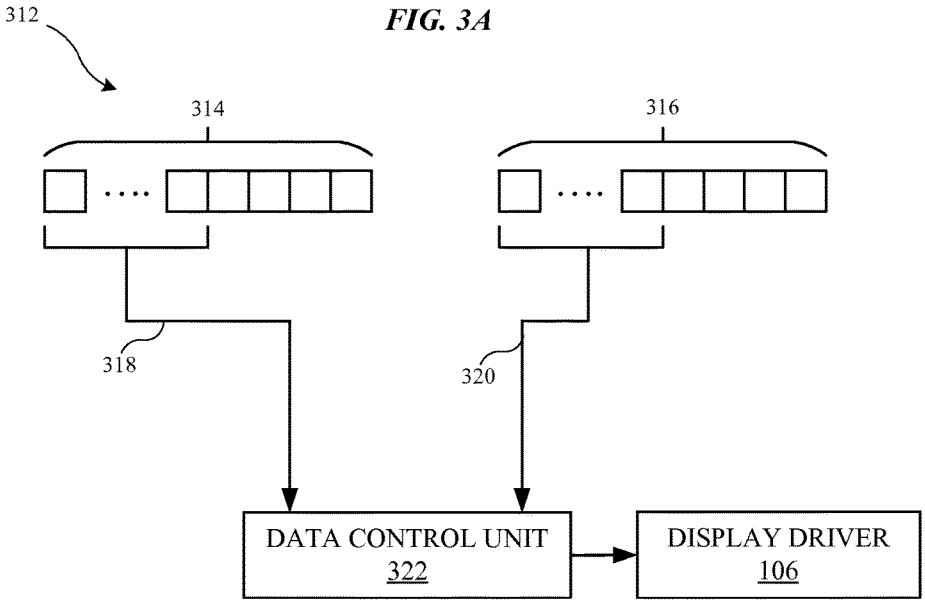

FIGS. 3A and 3B illustrate block diagrams 300 and 312 for executing the adaptive power saving scheme discussed herein. Specifically, FIG. 3A illustrates a block diagram 300 of a data control unit 310 receiving bits corresponding to analog signal levels that the display driver 106 can output for a particular LED in a particular row. In some embodiments, the data control unit 310 can receive a first most significant bit (MSB) 306 and a second MSB 308. The first MSB 306 can correspond to first content data 302 and the second MSB 308 can correspond to second content data 304 to be executed subsequent to the first content data 302. FIG. 3A provides an example where the first MSB 306 and second MSB 308 have the same MSB's (in this example, an MSB equal to 1). In order to perform the adaptive power saving scheme, the data control unit 310 will compare the MSB 306 and the second MSB 308. Because the first MSB 306 and second MSB 308 are the same, the voltage difference is less than half of the full scale of analog signal levels. In this case, the bias current can be set to 50% of the normal value used to charge the data line for the first content data 302. After the first content data 302 is executed, the settings for the second content data 304 are used to set the display driver 106 voltage and/or bias current to 50% of the normal value in order to save power. This process can continue for each subsequent content data until the end of a frame of content data. When a blank period is reached, corresponding to when the next frame is to be displayed at the display panel, the bias current can be restored so the data line can be charged in order to prepare for the content data in the next frame.

FIG. 3B illustrates block diagram 312 for executing the adaptive power saving scheme by comparing multiple bits of each content data. Specifically, FIG. 3B illustrates the data control unit 322 comparing sets of two or more bits from each of the first content data 314 and the second content data 316. In some embodiments, each of the first content data 314 and the second content data 316 can be less than or greater than 8-bits. Additionally, the data control unit 322 can be an entity in hardware or software that is external to the display driver 106, as illustrated in FIG. 3B. When comparing the sets of two or more bits, the data control unit 322 will determine the change in output voltage or analog signal level indicated by the differences in the sets of two or more bits from each of the first content data 314 and the second content data 316. For example, if there is a 20% change in output voltage, then the bias current corresponding to the second content data 316 can be set to 20% of the normal value. In some embodiments, any suitable percentage change in voltage can reduce the bias current in order to save power. In other embodiments, the percentages can be set according to a few set values separated by a fixed voltage change interval (e.g., 50% and 100%; or 25%, 50%, 75%, and 100%). Using four intervals, 0-25% voltage change will result in a 25% bias current; a 25-50% voltage change will result in a 50% bias current; a 50-75% voltage change will result in a 75% bias current, and a 75-100% change will result in a 100% bias current. For white, black, mosaic, or most web pages, the power savings can be 50% when only a two thresholds or intervals are used. Moreover, 75% power savings can be manifested using more intervals such as the four interval example described herein. Although the examples provided herein include two and four interval settings, it should be noted that more or less voltage change intervals corresponding to percentage changes in bias current can be provided in order to save power by reducing bias current.

Figure 4:
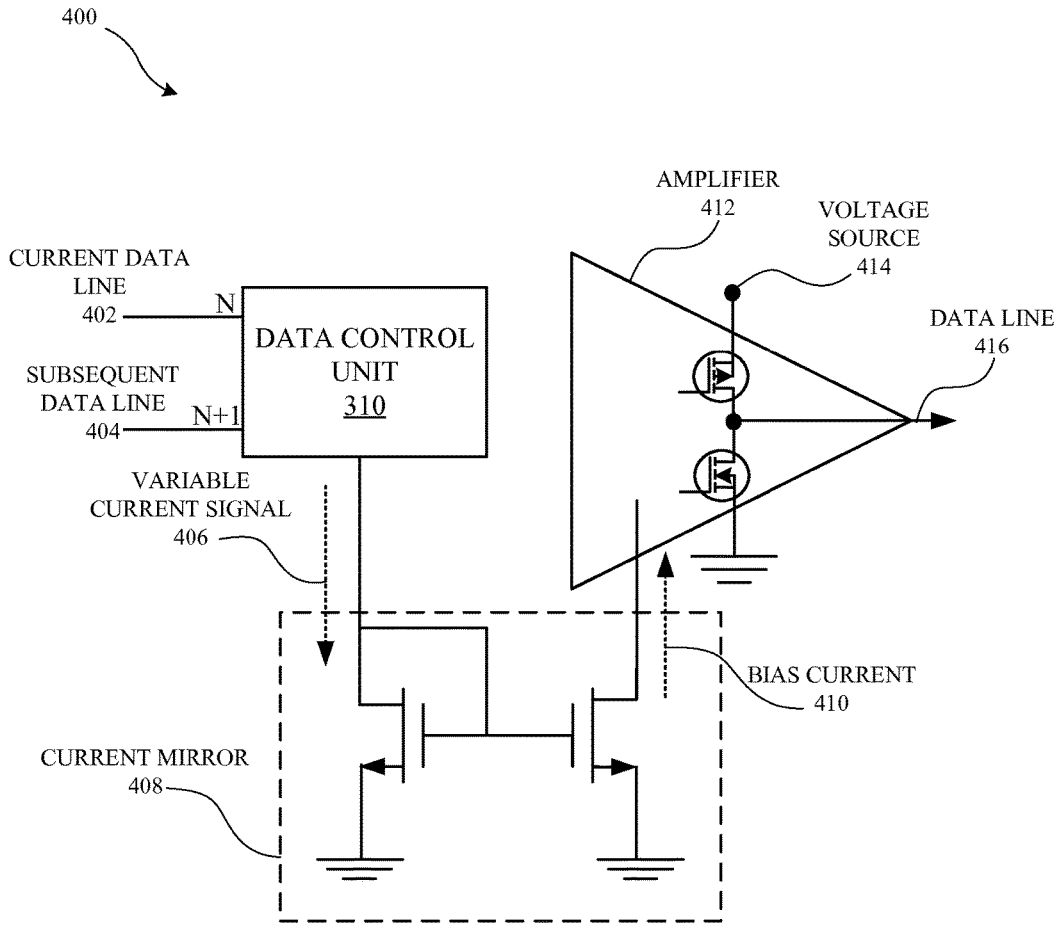
FIG. 4 illustrates a diagram for providing a bias current to a data line according to some embodiments discussed herein.

FIG. 4 illustrates a diagram 400 for providing a bias current to a data line 416 according to some embodiments discussed herein. According to FIG. 4, the current line data 402 corresponding to row N, and the subsequent line data 404 corresponding to row N+1 are provided to the data control unit 310. Each of the current line data 402 and the subsequent line data 404 can correspond to pixel values for the LED's associated with the data line 416 and row N and N+1, respectively. Based on a comparison between the current line data 402 and the subsequent line data 404, a variable current signal 406 is generated for the subsequent line. The variable current signal 406 can be provided to a current mirror 408, which is used to generate the bias current 410. Thereafter, the bias current 410 can be provided to an amplifier 412 connected to a voltage source 414 in order to amplify or otherwise condition the bias current 410 for the data line 416.

Figure 5:
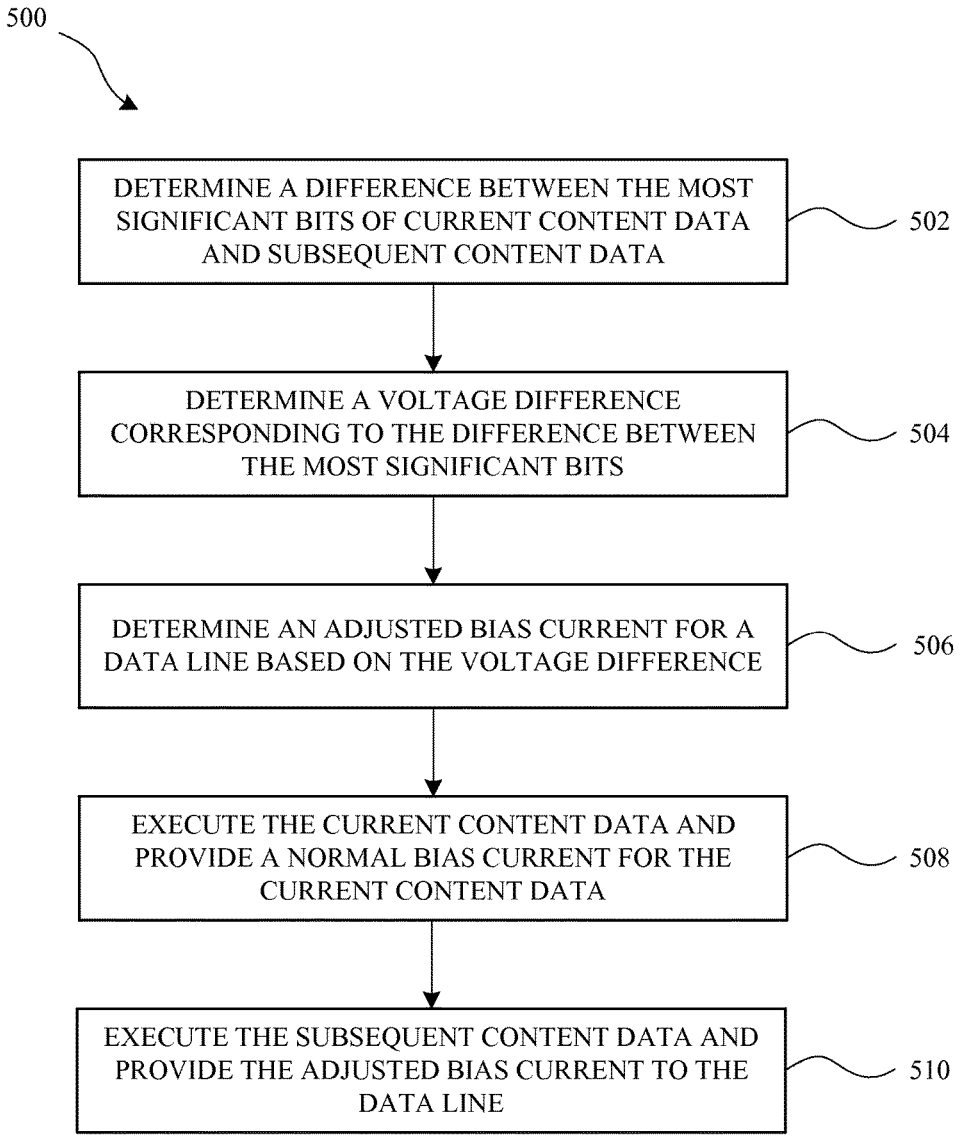
FIG. 5 illustrates a method for sequentially adjusting a bias current for a data line based on data content to be displayed at a display panel.

FIG. 5 illustrates a method 500 for sequentially adjusting a bias current for a data line based on data content to be displayed at a display panel. The method 500 can be performed by the display driver discussed herein, or any other suitable device or software for reducing the power consumption of a display panel. The method 500 can include a step 502 where a difference between the most significant bits of current content data and subsequent content data is determined. The content data can be a binary array of values corresponding to a desired analog signal level for a display driver. In this way, the display driver will adjust an analog signal output based on the desired analog signal level indicated in the content data. At step 504, a voltage difference corresponding to the difference between the most significant bits (from step 502) is determined. For example, when the display driver is instructed by the content data to reduce the analog signal output of a data line, there will be a difference in voltage at the data line before and after the reduction of the analog signal output. At step 506, an adjusted bias current for a data line is determined based on the voltage difference. At step 508, the current content data is executed according to a normal bias current for the current content data, or the bias current that is assigned to the value of the current content data. At step 510, the subsequent content data is executed and the adjusted bias current is provided to the data line accordingly.

Figure 6:
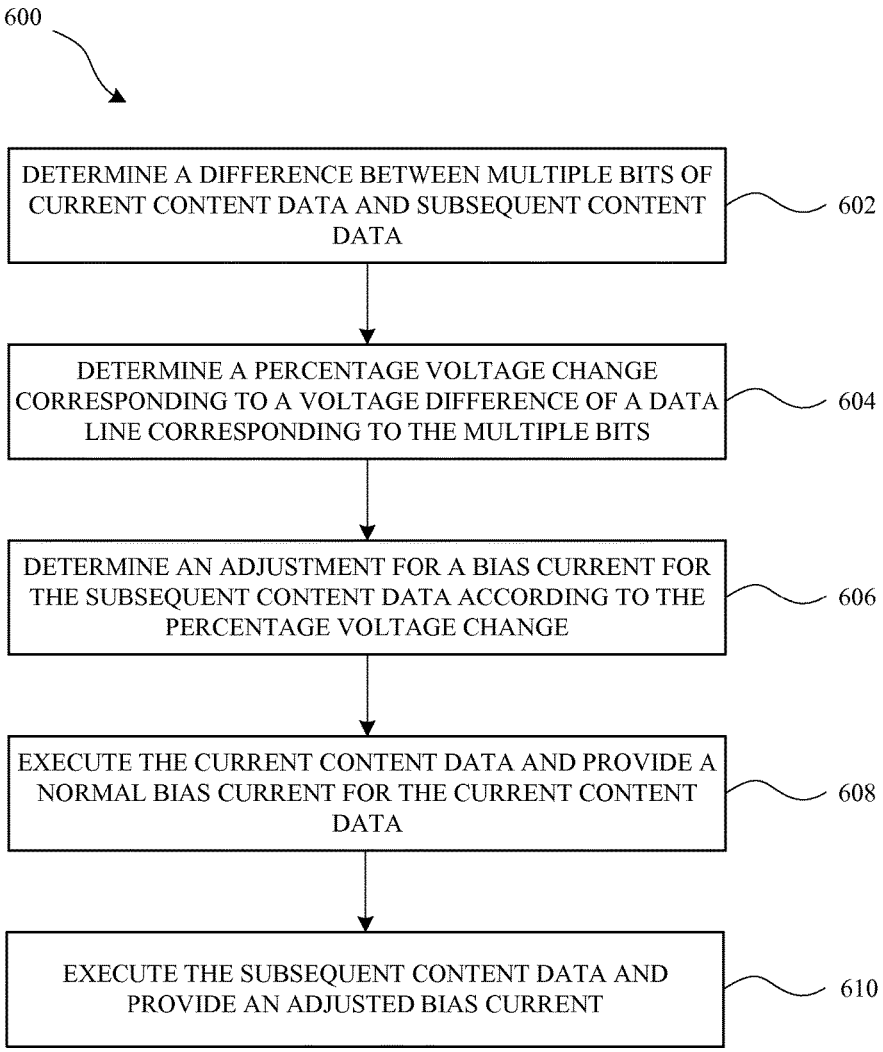
FIG. 6 illustrates a method for sequentially adjusting the bias current at a data line of a display panel in order to reduce the power consumption of the display panel.

FIG. 6 illustrates a method 600 for sequentially adjusting the bias current at a data line of a display panel in order to reduce the power consumption of the display panel. The method 600 can be performed by the display driver discussed herein, or any other suitable device or software for reducing the power consumption of a display panel. The method 600 can include a step 602 where a difference between multiple bits of current content data and subsequent content data are determined. The content data can correspond to the analog signal that is to be output from a display driver to a data line of a display panel in order to effectively illuminate an LED when the data line and a row line are concurrently charged. At step 604, a percentage voltage change corresponding to the difference between the multiple bits is determined. For example, each of the current content data and subsequent content data can correspond to an analog voltage output of the display driver. The analog voltage output can be a range of values depending on the size of the array in which the multiple bits are included. The multiple bits of each of the current content data and subsequent content data can include a most significant bit, as discussed herein, and/or any adjacent or neighboring bits to the most significant bit. At step 606, an adjustment for a bias current for the subsequent content data is determined according to a percentage of voltage change or voltage differential. For example, when there is no voltage change indicated (i.e., a voltage differential of approximately zero), the bias current can be reduced significantly (e.g., by half) for the subsequent content data because less bias current is required to keep the same voltage at the data line. However, if there is a significant change in voltage (e.g., 100% change), the bias current for the subsequent content data can be configured to not be reduced. In this way, because additional bias current may be required to adequately charge the data line when executing the subsequent content data, the bias current should not be reduced to save power in this instance. At step 608, the current content data is executed according to the normal bias current that is associated with the current content data. The normal bias current associated with the current content data can be determined by the data control unit discussed herein, or any other suitable mechanism or software for determining a current level (e.g., a lookup table stored in memory). At step 610, the subsequent content data is executed according to the determined adjustment for the subsequent content data.

Figure 7:
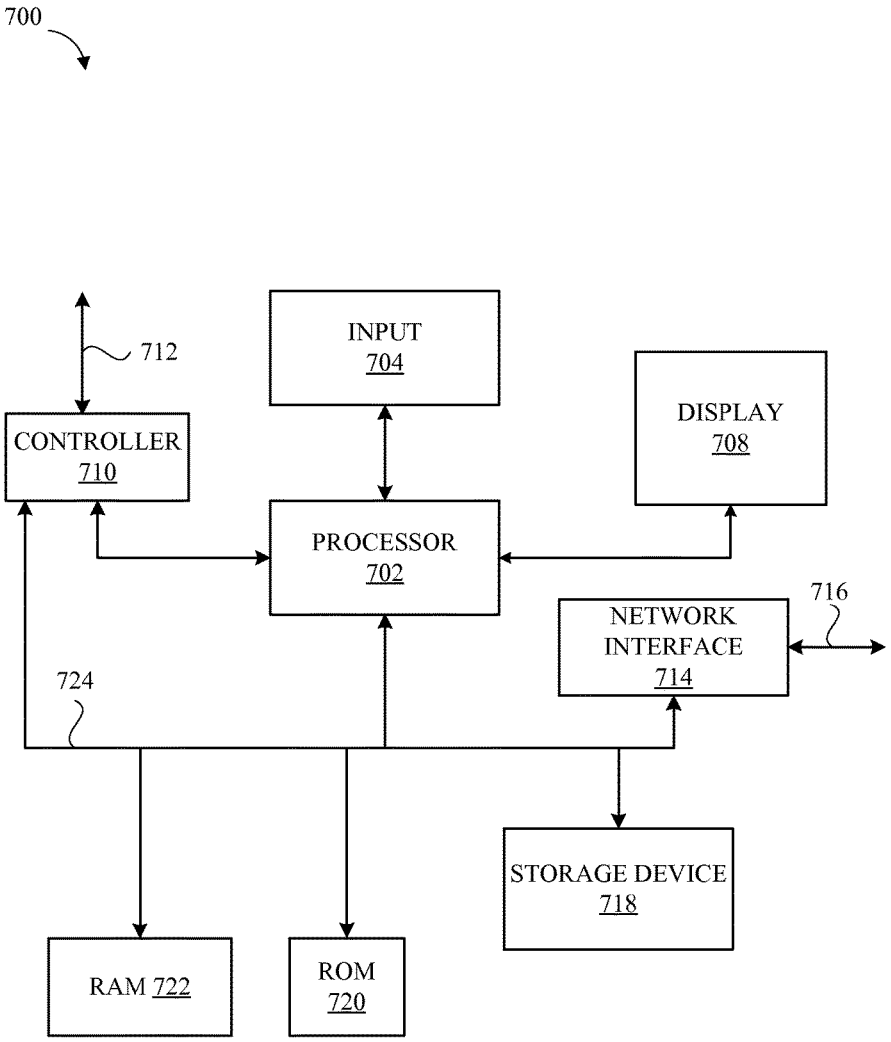
FIG. 7 is a block diagram of a computing device that can represent the components of the data control unit, display driver, and/or any other systems or apparatus discussed herein for reducing the power consumption of a display panel.

FIG. 7 is a block diagram of a computing device 700 that can represent the components of the data control unit 310, display driver 106, and/or any other systems or apparatus discussed herein for reducing the power consumption of a display panel. It will be appreciated that the components, devices or elements illustrated in and described with respect to FIG. 7 may not be mandatory and thus some may be omitted in certain embodiments. The computing device 700 can include a processor 702 that represents a microprocessor, a coprocessor, circuitry and/or a controller for controlling the overall operation of computing device 700. Although illustrated as a single processor, it can be appreciated that the processor 702 can include a plurality of processors. The plurality of processors can be in operative communication with each other and can be collectively configured to perform one or more functionalities of the computing device 700 as described herein. In some embodiments, the processor 702 can be configured to execute instructions that can be stored at the computing device 700 and/or that can be otherwise accessible to the processor 702. As such, whether configured by hardware or by a combination of hardware and software, the processor 702 can be capable of performing operations and actions in accordance with embodiments described herein.

The computing device 700 can also include user input device 704 that allows a user of the computing device 700 to interact with the computing device 700. For example, user input device 704 can take a variety of forms, such as a button, keypad, dial, touch screen, audio input interface, visual/image capture input interface, input in the form of sensor data, etc. Still further, the computing device 700 can include a display 708 (screen display) that can be controlled by processor 702 to display information to a user. Controller 710 can be used to interface with and control different equipment through equipment control bus 712. The computing device 700 can also include a network/bus interface 714 that couples to data link 716. Data link 716 can allow the computing device 700 to couple to a host computer or to accessory devices. The data link 716 can be provided over a wired connection or a wireless connection. In the case of a wireless connection, network/bus interface 714 can include a wireless transceiver.

The computing device 700 can also include a storage device 718, which can have a single disk or a plurality of disks (e.g., hard drives) and a storage management module that manages one or more partitions (also referred to herein as "logical volumes") within the storage device 718. In some embodiments, the storage device 718 can include flash memory, semiconductor (solid state) memory or the like. Still further, the computing device 700 can include Read-Only Memory (ROM) 720 and Random Access Memory (RAM) 722. The ROM 720 can store programs, code, instructions, utilities or processes to be executed in a non-volatile manner. The RAM 722 can provide volatile data storage, and store instructions related to components of the storage management module that are configured to carry out the various techniques described herein. The computing device 700 can further include data bus 724. Data bus 724 can facilitate data and signal transfer between at least processor 702, controller 710, network interface 714, storage device 718, ROM 720, and RAM 722.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable storage medium. The computer readable storage medium can be any data storage device that can store data which can thereafter be read by a computer system. Examples of the computer readable storage medium include read-only memory, random-access memory, CD-ROMs, HDDs, DVDs, magnetic tape, and optical data storage devices. The computer readable storage medium can also be distributed over network-coupled computer systems so that the computer readable code is stored and executed in a distributed fashion. In some embodiments, the computer readable storage medium can be non-transitory.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A method for providing a data line output from a display driver of a display device having a display panel, the method comprising:

receiving, at the display driver, at least one bit of current display content for display with a current row line of the display panel;

receiving, at the display driver, at least one bit of future display content for display with a subsequent row line of the display panel; and providing a modified bias current of the display driver according to a line charge differential for the current row line and the subsequent row line determined based on a comparison between the at least one bit of the current display content for display with the current row line and the at least one bit of the subsequent future display content for display with the subsequent row line.

2. The method as in claim 1, further comprising:

executing, after the current display content is executed with the current row line, the future display content with the subsequent row line concurrently with outputting the modified bias current from the display driver.

3. The method as in claim 1, further comprising:

providing a bias current to a first light emitting diode (LED) of the display panel corresponding to the current display content, and subsequently providing the modified bias current to a second LED of the display panel corresponding to the future display content.

4. The method as in claim 3, wherein a ratio of the bias current and the modified bias current is substantially proportional to the line charge differential.

5. The method as in claim 1, further comprising:

comparing a most significant bit (MSB) of both the current display content and the future display content.

6. The method as in claim 1, further comprising:

comparing the line charge differential to one or more adjustment thresholds, wherein each of the one or more adjustment thresholds corresponds to a proportion value for adjusting a bias current output of the display driver.

7. The method as in claim 1, further comprising:

providing the modified bias current by reducing a normal bias current by approximately 50 percent when the line charge differential is approximately zero, wherein the normal bias current corresponds to the normal bias current associated with the future display content.

8. A system for reducing power consumption of a display device having a display panel, based on content data to be displayed with the display panel of the display device, the system comprising:

a display driver electrically coupled to a data input unit and to at least one data line of the display panel, wherein the display driver is configured to:

receive, from the data input unit, current content data and future content data to be respectively displayed using two different row lines of the display panel; and modify a bias current output of the display driver when the current content data and the future content data provided by the data input unit is indicative of a charge differential between the two row lines that is within one or more charge differential thresholds accessible to the display driver.

9. The system as in claim 8, wherein the one or more charge differential thresholds correspond to a voltage difference of the at least one data line of the display driver.

10. The system as in claim 9, wherein the voltage difference is a difference between a first voltage of the at least one data line when the current content data is executed using a first one of the two row lines, and a second voltage of the at least one data line when the future content data is executed using a second one of the two row lines.

11. The system as in claim 8, wherein the current content data includes a first data array and the future content data includes a second data array, wherein the display driver is configured to execute the second data array subsequent to the first data array.

12. The system as in claim 8, wherein the one or more charge differential thresholds correspond to a percentage that the bias current output can be increased or decreased by depending on the charge differential indicated by the current content data and the future content data.

13. The system as in claim 8, wherein the current content data and the future content data includes at least two arrays of bits, and the display driver is configured to compare at least one bit of each of the least two arrays of bits to determine the charge differential.

14. The system as in claim 13, wherein the display driver is further configured to reduce the bias current output when the charge differential is substantially zero.

15. A display driver directly coupled to a plurality of data lines of a display panel and configured to reduce power consumption by the display panel having at least a first row line and a second row line, based on content data to be displayed by the display panel, the display driver comprising:

a current output unit; and a data control unit configured to:

determine a modified bias current for the current output unit based on a voltage differential generated by sequentially comparing a current content value to a future content value, wherein the second future content value variable is arranged to be executed for display by the display panel using the second row line of the display panel subsequent to execution of the current content value for display by the display panel using the first row line of the display panel.

16. The display driver as in claim 15, wherein the current output unit is configured to provide the modified bias current to at least one of the plurality of data lines of the display panel subsequent to the voltage differential being generated at the data control unit.

17. The display driver as in claim 15, wherein sequentially comparing the current content value to the future content value includes comparing a most significant bit (MSB) of each of the current content value to the future content value.

18. The display driver of claim 15, wherein the modified bias current is less than a normal bias current associated with the current content value when the current content value is equal to the future content value.

19. The display driver as in claim 15, wherein the future content value is associated with a normal bias current that is adjusted according to the voltage differential in order to provide the modified bias current.

20. The display driver as in claim 19, wherein the data control unit is further configured to:

compare the voltage differential to one or more adjustment thresholds, and adjust the normal bias current according to the one or more adjustment thresholds.

* * * * *